United States Patent [19]

Ely

[11] Patent Number: 4,510,698

[45] Date of Patent: Apr. 16, 1985

[54] DRYER FELT RUN

[75] Inventor: Donald A. Ely, Roscoe, Ill.

[73] Assignee: Beloit Corporation, Beloit, Wis.

[21] Appl. No.: 447,701

[22] Filed: Dec. 7, 1982

Related U.S. Application Data

[63] Continuation-in-part of Ser. No. 426,609, Sep. 29, 1982, Pat. No. 4,485,567.

[51] Int. Cl.[3] ..... F26B 13/08

[52] U.S. Cl. ..... 34/117; 34/116; 34/123

[58] Field of Search ..... 34/116, 117, 120, 123, 34/111

[56] References Cited

U.S. PATENT DOCUMENTS

| | | | |
|---|---|---|---|
| 3,011,544 | 12/1961 | Lippke | 34/117 |
| 3,555,700 | 1/1971 | Wagner | 34/116 |
| 3,751,822 | 8/1973 | Crist | 34/116 |
| 3,815,256 | 6/1974 | Ely | 34/116 |

*Primary Examiner*—Larry I. Schwartz

*Attorney, Agent, or Firm*—Hill, Van Santen, Steadman & Simpson

[57] ABSTRACT

A web dryer structure for thermal removal of liquid from a traveling web such as a web of paper coming from the press section of a papermaking machine including a row of upper dryer drums and a row of lower dryer drums with the drums positioned to carry the web in a sinuous path successively between upper and lower drums and the web wrapping the upper and lower surfaces of the drums respectively with upper and lower looped felts wrapping the web on the upper and lower surfaces of the drums with the felt guided by felt rolls which for the upper felt is beneath lower drums and for the lower felts are between the upper drums with the felt rolls being hollow roll shells and having glands therein divided so that a first portion of the felt roll faces the onrunning web and a second portion faces the offrunning web with the vacuum means and pressure means connected to the interior of the felt rolls so that one portion is subjected to a vacuum, and the other portion is subjected to a pressure, and the arrangement accommodates running the web in either direction without the necessity to have any open unsupported travel of the web.

9 Claims, 4 Drawing Figures

DRYER FELT RUN

BACKGROUND OF THE INVENTION

The present application is a continuation-in-part of my copending application, Ser. No. 426,609, filed in the Patent and Trademark Office on Sept. 29, 1982, Entitled "Dryer Felt Run" now U.S. Pat. No. 4,485,567.

The invention relate to improvements in dryer drum structures for drying a traveling web, and more particularly to a structure which is used for thermally drying a web such as a continuous run of paper which is received at high speed from the press section of a papermaking machine.

More particularly, the invention relates to a particular arrangement and guidance for the web and felts which are threaded over the dryer drums with means for subjecting the web to zones in the felt or pressure and vacuum rolls for improved control of the web and improved removal of moisture to enhance the operation of the dryer, without open unsupported travel of the web.

In the dryer section of a thermal dryer such as for a paper machine, the liquid or moisture carrying web is received from the press section of the machine and is directed along a serpentine path in wrapped relation with a plurality of steam heated dryer drums. These drums are usually arranged in upper and lower rows with the drums staggered so that the paper web can pass back and forth in a serpentine path and wrap the upper and lower drums with the moisture evaporating from the web. To aid in the heat transfer from the drum to the web and to support the web in travel between the drums, upper and lower looped felts are provided which wrap the outer surface of the web while on the drum surface.

In relatively high speed papermaking machines, disadvantages have been encountered that the web is not controlled in transfer between the upper and lower felts and is sometimes lost. Further, other disadvantages are encountered in that moisture which is removed by heating is not carried away as fast as possible.

It is accordingly an object of the present invention to provide an improved dryer section arrangement which improves the handling and transfer of the web and which also improves the removal of moisture therefrom. This objective generally is desired and sought after because with the increase in speed of papermaking machines, it is necessary for the dryer section to be able to accommodate such increase in speed, without increasing the sheet strength and consequent increased cost and with a minimum of sheet wrinkles and paper breaks, plus lost production.

A further object of the invention is to provide a web handling arrangement for a dryer section of a papermaking machine which achieves and accommodates more uniform drying across the width of the sheet and which helps avoid the complications of buildup of air flow or windage and buildup of moisture in the pockets formed between the felts, the dryer drums, and the felt rolls.

A feature of the invention is the provision of felt rolls for the felts which are constructed as perforated roll shells with glands within the roll shells that divide the areas into a pressure and vacuum chamber or vacuum and pressure so that the web is alternately subjected to vacuum and pressure as it travels over the roll. This unique arrangement has been discovered to avoid damages in web handling and drying in both arrangements.

Other objects and advantages and features wi11 become more apparent with the teaching of the principles of the invention in connection with the disclosure of the preferred embodiments thereof in the specification, claims and drawings, in which:

DESCRIPTION OF THE PREFERRED EMBODIMENTS

Figure 1:
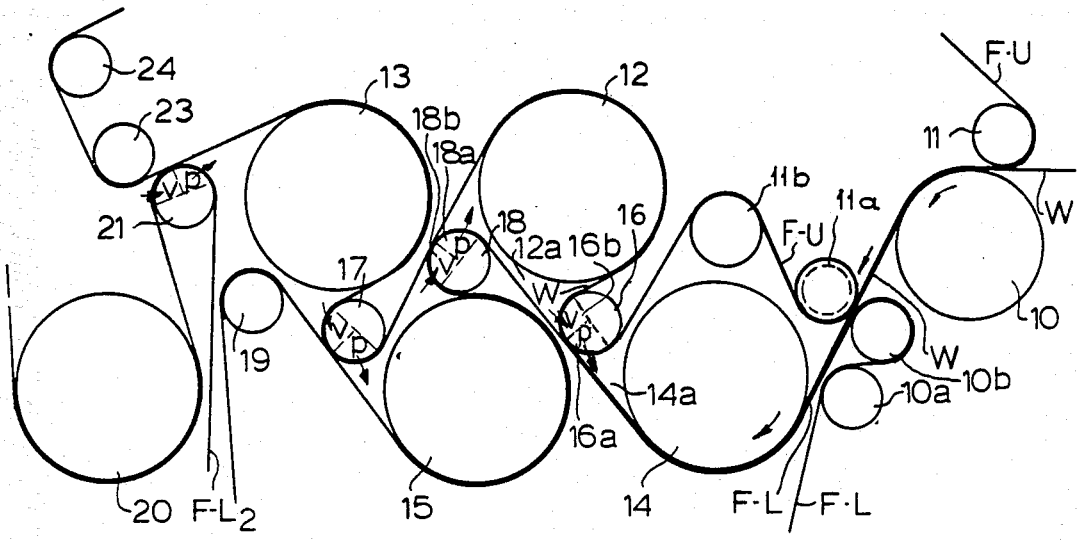
FIG. 1 is a somewhat schematic side elevational view of a dryer section of a papermaking machine constructed and arranged to embody the principles of the present invention.

As illustrated in FIG. 1, a web W is received from a press section, not shown, in a papermaking machine to pass into a dryer section shown in FIG. 1. As the web W passes over a roll 10, it is received by an upper felt F-U threaded down onto the web over a guide roll 11. The web then becomes sandwiched between the upper felt F-U and a lower felt F-L guided up over guide rolls 10*a* and 10*b*.

In the dryer section, the web is threaded over dryer drums alternately carried by the felts F-U and F-L, and the felts are threaded by felt rolls to wrap the web on the drums.

Generally the dryer drums are steam heated cylindrical cast iron drums as will be known to those versed in the art, arranged in an upper row as illustrated by the drums 12 and 13 and arranged in a lower row as illustrated by the drums 14 and 15.

In the travel of the felts through the dryer drum system, the felts are guided by two types of rolls. One type of roll will be referred to as felt rolls including numbers 16, 17, 18, 21, 37, 38, 39 and 40, and these rolls comprise perforate rotatable roll shells with glands therein which expose the perforations of the roll shells to either pressure or vacuum to thereby subject the felt and the web carried thereby to a pressure or vacuum as will be more fully described. The other type of rolls will be referred to as guide rolls, and these are solid rolls which are positioned to help guide the path of travel of the felts, and the guide rolls are numbers 10*a*, 10*b*, 11, 11*a*, 11*b*, 19, 23, 24, 31, 32, 42 and 43.

The upper felt F-U is threaded over upper felt rolls such as 16 and 17 which are positioned beneath the upper drums 12 and 13 respectively. The lower felt F-L is guided over lower guide rolls such as 18 and 19 with the felt roll 18 positioned above the lower drum 15. In the construction embodying the principles of the present invention, each of the felt rolls are constructed as hollow roll shells with glands within the shells so that a portion can be subjected to a vacuum and a portion subjected to pressure as will be described in further detail in connection with FIGS. 3 and 4. As illustrated therein, the hollow roll shells 45 are supported on end bearings 46 to be either driven in rotation or to rotate due to frictional contact with the felts. The hollow roll shells are perforate having openings 47 therethrough so as to expose the felt and the web carried on the surface to the pressure or vacuum within the felt roll.

Figure 4:
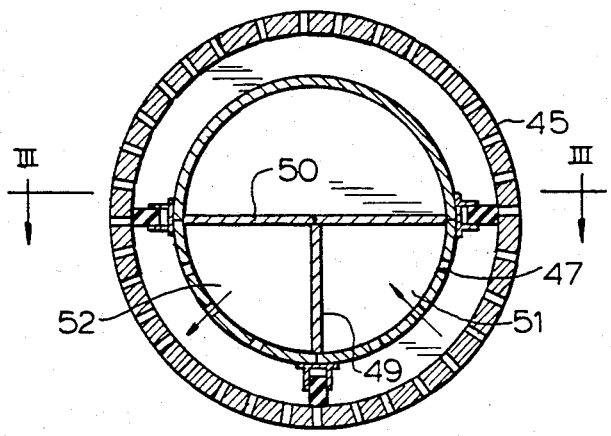
FIG. 4 is a sectional view taken generally along line IV—IV of FIG. 3.

As illustrated in FIG. 4, a gland or gland walls 49 and 50 are positioned within the hollow roll shell to divide the roll shell into first and second portions, with one portion being subjected to a vacuum, and the other portion being subjected to a pressure. As illustrated in FIG. 4, the portion 51 is subjected to a vacuum, and the portion 52 subjected to a pressure, and the arrowed lines in FIG. 4 illustrate the direction of flow of air relative to the roll shell.

Figure 3:
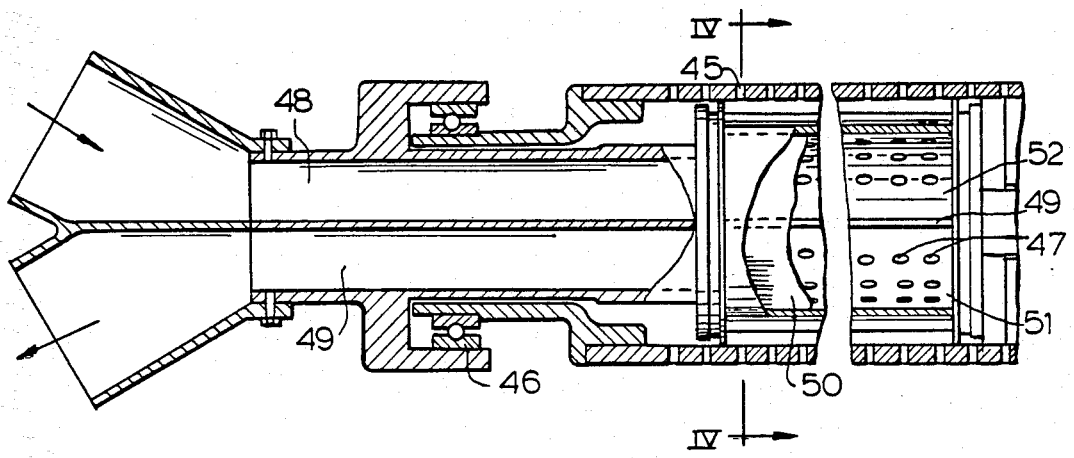
FIG. 3 is a sectional view taken through a felt roll generally along line III—III of FIG. 4.

As illustrated in FIG. 3, a conduit 48 connects to the portion 52 to pressurize that portion. Similarly, a conduit 49 connects to a vacuum to subject the portion 51 to a vacuum. Suitable pressure and vacuum means are provided shown schematically by the arrowed lines in FIG. 3, and pumps or fans of known construction will be arranged to provide the pressure and vacuum.

Returning to the arrangement shown in FIG. 1, the upper felt F-U is led away from the web by a grooved guide roll 11*a* before the web reaches the dryer drum 14. The felt F-U passes up over a further guide roll 11*b* and then is threaded down onto a felt roll 16 to pick up the web which has been carried up to the felt roll 16 on the felt F-L.

Just prior to where the upper felt F-U leaves the web, the web is picked up by a lower felt F-L and the guide rolls 10*b* and 11*a* form a nip to transfer the web from the upper felt F-U to the lower felt F-L. The lower felt carries the web down into direct contact with the dryer drum 14. After the web leaves the lower dryer drum 14, it is first subjected to a pressure from the portion 16*a* of the guide roll 16 in the area 14*a*. As it leaves the bottom felt F-L, the sheet is subjected to a vacuum in the portion 16*b* of the felt roll. The glands within the felt rolls are arranged so that the web on its onrunning side is subjected to a pressure and on the offrunning side, is subjected to a vacuum. The pressure on the onrunning side helps force a flow of air out of the pocket 14*a* and holds the web on the felt F-L. The pressure may also cause a flow of air into the area on the onrunning side of roll 16 which helps carry away the moisture vapor which is present in the zone 14*a* following the drum 14.

The vacuum in the portion 16*b* of the felt roll helps transfer the web onto the upper felt F-U on the offrunning side of the felt roll. Also, there may be some air transfer through the web and upper felt to aid in the drying process, and this helps evacuate the zone or pocket 12*a* ahead of the dryer drum 12.

As the web is carried over the upper dryer drum and onto the felt roll 18, it is first met with pressure from the portion 18*a*. It is next subjected to a vacuum on the offrunning side as it is exposed to the portion 18*b* of the felt roll 18. This aids in transfer of the web to the lower felt F-L which carries the web down over the lower dryer drum 15. The web is next carried onto the felt roll 17 where it is first subject to pressure on the onrunning side and then subject to a vacuum on the offrunning side to transfer it to the upper felt F-U to be carried up over the upper dryer drum 13. Following the upper dryer drum, the web and upper felt pass over the felt roll 21 whereupon the web is transferred to a second lower felt F-L2 to be carried down over the surface of a lower dryer drum 20. The upper felt is guided away over guide rolls 23 and 24.

Figure 2:
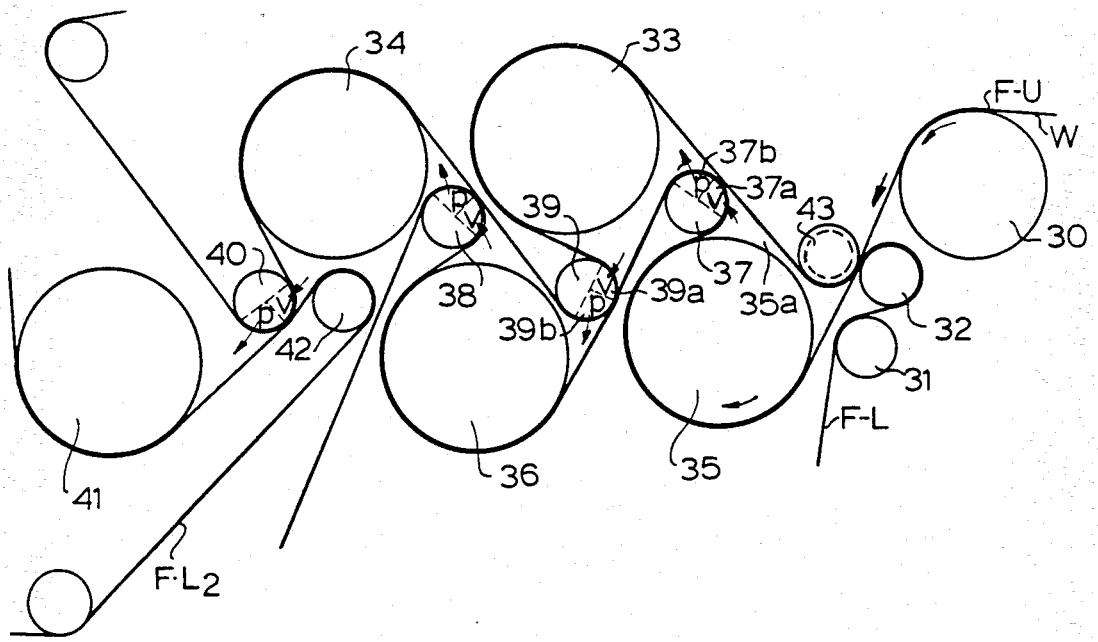
FIG. 2 is another somewhat schematic elevational view similar to FIG. 1, but showing an alternate arrangement.

In the construction of FIG. 2, essentially the same structural elements are employed, but the travel of the web, or in other words, the effect thereon is reversed with the web first being subjected to a vacuum and subsequently to a pressure as it travels over each felt roll. In other words, in the arrangement of FIG. 1, the web sees in sequence a pressure and then a vacuum as it travels over the felt rolls, and in the arrangement of FIG. 2, the web sees a vacuum and then a pressure as it travels over the felt rolls. The web is subjected to advantageous treatment in each arrangement with the same roll construction being used. The papermaker can attain the desired arrangement by merely reversing the pressure and vacuum lines, or a valving arrangement may be used for rapid interchange of these lines and changing the felt run.

In the arrangement of FIG. 2, a web W enters a dryer section carried on an upper felt F-U over a roll 30. It is then sandwiched between the felt F-U and a lower felt F-L which is carried up beneath the web over guide rolls 31 and 32. The upper felt is led away from the web on a grooved guide roll 43.

The web is carried down over a lower drum 35 on the lower felt F-L. The dryer section is arranged very similar to the arrangement in FIG. 1 with a lower row of drums 35 and 36, and an upper row of drums 33 and 34. The lower drums receive the lower felt F-L which is guided by felt rolls 37 and 38 which are positioned over the lower drums 35 and 36 respectively, and are positioned essentially between the upper drums.

The upper felt F-U is guided to wrap the upper drums 33 and 34 by felt rolls 39 and 40 which are positioned beneath the upper drums 33 and 34. Each of the felt rolls are constructed as hollow roll shells, as illustrated in FIGS. 3 and 4, and each are provided with glands therein so that the web is subjected to a vacuum on the onrunning side of the felt roll and to a presure on the offrunning side.

As the web is carried over the drum 35 and up over the felt roll 37, it is first subjected to a vacuum which aids in the keeping the sheet on the felt. On the offrunning side, a pressure is directed out through the lower felt to aid in the transfer of the web onto the upper felt F-U. The felt roll 37 has a first portion 37*a* which is subjected to a vacuum and a second portion 37*b* which is subjected to a pressure. Thus, with the same construction, a vacuum is used in the arrangement of FIG. 1 for the transfer of the web, and a pressure is used in the arrangement of FIG. 2 for the transfer of the web. In both arrangements, the vacuum and pressure are utilized to carry air from or to the zone between the felt roll and dryer drum to aid in carrying away moisture in the zone.

As the web is carried by the upper felt, following the felt roll 37, it is carried over the upper dryer drum 33 and then down over the felt roll 39 where it is first subject to a vacuum from the section 39*a* of the felt roll and then is subjected to a transfer pressure from the section 39*b* of the felt roll. The web is then carried by the lower felt F-L over the lower dryer drum 36 and up over the felt roll 38 where it is transferred to the upper felt to be carried over the upper drum 34. Following this, the web passes down over a felt roll 40 where it is transferred to a second lower felt F-L2 which is threaded up over a guide roll 42 to wrap the outer surface of the web on the felt roll 40. The web then is carried by the lower felt F-L2 over a further lower dryer drum 41.

The arrangement above described can be repeated throughout the section of the dryer for as many dryer drums as is necessary to attain a drying of the web.

It will be noted that in the arrangement of FIG. 1, the web is threaded so that it wraps the lower portion of the upper dryer drums on the oncoming side, and wraps the upper portion of the lower drums on the oncoming side.

In the arrangement of FIG. 2, the web wraps the upper portion of the lower drums on the offrunning side and similarly wraps the lower portion of the upper drums on the offrunning side, and this effect is achieved by the arrangement of the felts relative to the felt rolls. Thus, with a given felt run, the mechanism can be arranged to attain the advantages of either subjecting the web first to a vacuum and then to a pressure or in the opposite arrangement, first to a pressure and then to a vacuum. In the first arrangement, the vacuum is used for the web transfer, and in the second arrangement, the pressure is used for the web transfer. Various operating conditions and various types of paper will dictate which arrangement is most advantageous.

A preferred arrangement is shown, but the arrangement shown in FIG. 2 could be used with grooved felt rolls on some grades or paper without the vacuum and pressure zones. The felt rolls would be grooved about 3/16 wide×3/16 deep with 3/16 land areas between the grooves. Other groove patterns could also be used, but generally with a surface pattern with 50% open area and 50% land area and about ⅛ to ¼ inches deep.

The drying system shown and described herein is referred to as functioning to remove water vapor or moisture from the web, and it is to be understood that the term moisture is not restrictive in that liquids other than water may be used in the paper making process. For example, U.S. Pat. No. 3,791,044 shows tetrachloroethylene (TCE) used instead of water. Therefore, the features of the invention may be employed to remove wetness of all types from webs including water and TCE.

As stated above, the embodiment of FIG. 2 could be modififed from the preferred arrangement shown to provide felt rolls which do not have the pressure and vacuum chambers, but which are grooved rolls inasmuch as the grooves would break the vacuum between the web and grooved roll surface at the points where the web begins wrapping the felt rolls 37, 38 and 39. If these felts rolls are either not grooved nor equipped with the vacuum and pressure glands shown in FIG. 2, air would be trapped between the felt roll surface and the felt which would tend to cause the web to billow off the felt. The use of grooved rolls for the felt rolls is not a preferred structure, but a possible structure.

Felt rolls 37, 38 and 39 in FIG. 2 are preferably perforate rolls with the pressure and vacuum chambers therein as illustrated in FIG. 2, but grooved rolls may be employed in some circumstances. In FIG. 1, the felt rolls 16, 17, and 18 each transfer the web off the felt as it comes off the dryer roll and onto the next felt which wraps the felt roll leading to the next dryer drum. By contrast, in FIG. 2, the felt rolls 37, 38 and 39 each transfer the web which is already on the felt wrapping the felt roll off of the felt onto the other felt leading to the next dryer roll. In FIG. 1, the transfer is made from a straight running felt run to the felt which wraps the felt roll. In FIG. 2, the transfer is made from the felt wrapping the felt roll onto the straight run of felt.

Thus, it will be seen that I have provided an improved dryer arrangement which meets the objectives and advantages above set forth and which enables better and more uniform drying on higher speed paper-making machines, without any open draws in the sheet travel.

I claim as my invention:

1. A paper or board dryer for the removal of liquid from a traveling web comprising in combination:

a plurality of rotatably mounted upper dryer drums adapted to be heated to carry a web and evaporate moisture therefrom;

a plurality of rotatably mounted lower dryer drums adapted to be heated to carry the web and evaporate moisture therefrom;

said drums positioned to carry the web in a sinuous path passing successively between the upper and lower drums with the web wrapping the upper and lower surfaces of the drums respectively;

upper and lower looped felts formed of a pervious material accommodating the escape of water vapor from the web and wrapping the web on the upper and lower surfaces of the upper and lower drums respectively;

upper and lower felt rolls for the upper and lower felts respectively with one felt roll between each pair of adjacent drums for the upper drums and for the lower drums;

said lower felt rolls positioned to carry the portion of the upper felt between the adjacent lower drums into the spaces between the lower drums;

said upper felt rolls positioned to carry the portions of the lower felt between adjacent upper drums into the spaces between said upper drums;

said felt rolls being formed of perforate roll shells;

glands inside of said roll shells dividing the shells into a first portion exposed to the oncoming web and a second portion exposed to the offrunning web;

pressure means connected to one of said portions of said glands; and vacuum means connected to the other of said portions of said glands so that the web is subjected to pressure and vacuum in its travel across the felt roll and the spaces between the drums and the felt rolls are subjected to pressure and vacuum;

said felt rolls and drums positioned so that the felt and web runs are arranged to eliminate any open unsupported web runs and the web is automatically transferred between top and bottom dryer felts without subjecting the web to an open unsupported web run.

2. A paper or board dryer for the removal of liquid from a traveling web constructed in accordance with claim 1:

wherein the felt roll and pressure and vacuum means are constructed so that the first portion is subjected to a vacuum and said second portion is subjected to a pressure.

3. A paper or board dryer for the removal of liquid from a traveling web constructed in accordance with claim 1:

wherein the felt roll and pressure and vacuum means are constructed so that the first portion is subjected to a pressure and said second portion is subjected to a vacuum.

4. A paper or board dryer for the removal of moisture from a traveling web comprising in combination:

a plurality of rotatably mounted upper dryer drums adapted to be heated to carry a web and evaporate liquid therefrom;

a plurality of rotatably mounted lower dryer drums adapted to be heated to carry the web and evaporate liquid therefrom;

said drums positioned to carry the web in a sinuous path passing successively between the upper and lower drums with the web wrapping the upper and lower surfaces of the drums respectively;

upper and lower looped felts formed of a material accommodating the escape of moisture from the web and wrapping the web on the upper and lower surfaces of the upper and lower drums respectively;

upper and lower felt rolls for the upper and lower felts respectively for guiding the felts from one roll to the next and positioned so that the web transfers from one felt to the other in travel from the upper dryer drums to the lower dryer drums and back to the upper dryer drums;

said felt rolls having glands therein dividing the rolls to a first portion facing the oncoming web as it is wrapped over the felt roll and a second portion facing the web on the offrunning side of the felt roll;

pressure means connected to one portion of said gland; and vacuum means connected to the other portion of the glands of each of the felt rolls so that the zone facing the web on one side of the felt roll is subjected to pressure and the zone on the other side of the felt roll is subjected to a vacuum;

said felts and felt rolls positioned so that the web has an absence or a minimum of unsupported web runs.

5. A paper or board dryer for the removal of liquid from a traveling web constructed in accordance with claim 4:

wherein the portion of the felt roll on the onrunning side is subject to pressure and the portion on the offrunning side is subject to vacuum.

6. A paper or board dryer for the removal of liquid from a traveling web constructed in accordance with claim 4:

wherein the portion on the onrunning side of the felt roll is subjected to vacuum and the portion on the offrunning side is subjected to a pressure.

7. A paper or board dryer for the removal of liquid from a traveling web comprising in combination:

a plurality of rotatably mounted upper dryer drums adapted to be heated to carry a sheet and evaporate liquid therefrom;

a plurality of rotatably mounted lower dryer drums adapted to be heated to carry the sheet and evaporate liquid therefrom;

said drums positioned to carry the web in a sinuous path passing successively between the upper and lower drums with the web wrapping the upper and lower surfaces respectively;

upper and lower looped felts formed of a pervious material accommodating the escape of liquid vapor from the web and wrapping the web on the upper and lower surfaces of the upper and lower drums respectively;

upper felt rolls for the upper felts with one felt roll positioned beneath each of the upper drums and between adjacent lower drums;

lower felt rolls positioned above each of the lower drums and between adjacent upper drums;

means guiding said web over a lower drum and then over an upper felt guide roll and then causing it to wrap an upper drum and then travel over a lower felt roll;

said guide rolls being hollow perforate roll shells with glands therein dividing the interior of the shell into a first portion facing the onrunning web and a second portion facing the offrunning web;

vacuum means subjecting one of said portions to a vacuum; and pressure means subjecting the other of said portions of each of the felt rolls to a pressure whereby the zone opposite the pressure means outside of the felt roll is pressurized in the zone opposite the vacuum means outside of the felt roll subjected to a vacuum;

said felts and felt rolls positioned so that the web has an absence of unsupported runs.

8. A paper or board dryer for the removal of liquid from a traveling web comprising in combination:

a plurality of rotatably mounted upper dryer drums adapted to be heated to carry a web and evaporate liquid therefrom;

a plurality of rotatably mounted lower dryer drums adapted to be heated to carry the web and evaporate liquid therefrom;

said drums positioned to carry the web in a sinuous path passing successively between the upper and lower drums with the web wrapping the upper and lower surfaces respectively;

upper and lower looped felts wrapping the web on the upper and lower surfaces of the upper and lower drums respectively;

upper felt rolls on the upper felts with one felt roll positioned beneath each of the upper drums and between adjacent lower drums;

lower felt rolls positioned above each of the lower drums and between adjacent upper drums;

means guiding the web over a lower drum and then up over an upper felt roll and then up over an upper drum and down over a lower felt roll;

said felt rolls being hollow roll shells;

means dividing the interior of the felt roll shells into a first portion facing the oncoming web and a second portion facing the offrunning web;

vacuum means connected to the felt rolls and subjecting one of said portions to a vacuum; and pressure means subjecting the other of said portions of the felt rolls to a pressure so that the zone opposite the vacuum means outside of the felt roll is subject to a vacuum and the zone outside of the pressure section of the guide rolls is subjected to a pressure; said felts and felt rolls positioned so that the web has an absence of unsupported runs.

9. A paper or board dryer for the removal of liquid from a traveling web comprising in combination:

a plurality of rotatably mounted upper dryer drums adapted to be heated to carry a web and evaporate moisture therefrom;

a plurality of rotatably mounted lower dryer drums adapted to be heated to carry the web and evaporate moisture therefrom;

said drums positioned to carry the web in a sinuous path passing successively between the upper and lower drums with the web wrapping the upper and lower surfaces respectively;

upper and lower looped felts formed of a pervious material accommodating the escape of vapor from the web and wrapping the web on the upper or lower surfaces of the upper and lower drums respectively;

means guiding the upper felt onto the upper surface of a web at a first dryer drum;

means guiding the lower felt beneath the web between the first and a second dryer drum by a first lower felt roll;

an upper grooved guide roll forming a nip with said first lower felt guide roll leading the upper felt away from the web in advance of a second dryer drum;

a perforate felt roll between the second and a third dryer drum for guiding the web onto the third dryer drum;

means guiding the upper felt over said felt roll onto the upper surface of the web with the lower felt separating from the web at said perforated felt roll;

means dividing the interior of said perforate felt roll into a first pressure zone facing the oncoming web and a second vacuum zone on the offrunning side of the perforate roll; said felts and felt rolls positioned so that the web has an absence of unsupported runs.

* * * * *